US012241671B1

(12) United States Patent
Livingood

(10) Patent No.: US 12,241,671 B1
(45) Date of Patent: Mar. 4, 2025

(54) ICE WALL SYSTEM AND METHOD OF CONSTRUCTION

(71) Applicant: Cory Livingood, Ashville, NC (US)

(72) Inventor: Cory Livingood, Ashville, NC (US)

( * ) Notice: Subject to any disclaimer, the term of this patent is extended or adjusted under 35 U.S.C. 154(b) by 197 days.

(21) Appl. No.: 17/989,993

(22) Filed: Nov. 18, 2022

(51) Int. Cl.
*F25C 1/12* (2006.01)
*F25C 3/00* (2006.01)

(52) U.S. Cl.
CPC . *F25C 1/12* (2013.01); *F25C 3/00* (2013.01)

(58) Field of Classification Search
CPC ..... F25C 1/12; F25C 1/02; F25C 3/00
See application file for complete search history.

(56) References Cited

U.S. PATENT DOCUMENTS

| | | | | |
|---|---|---|---|---|
| 4,057,967 | A * | 11/1977 | Hill | F25C 1/02 62/235 |
| 8,511,042 | B2 | 8/2013 | Christensen | |
| 10,422,564 | B2 * | 9/2019 | Christensen | F25C 1/22 |
| 2022/0196311 | A1 * | 6/2022 | Youngstrom | F25C 1/04 |

FOREIGN PATENT DOCUMENTS

| | | | |
|---|---|---|---|
| ES | 2340747 | A1 | 6/2010 |

* cited by examiner

*Primary Examiner* — Joseph F Trpisovsky
(74) *Attorney, Agent, or Firm* — Michael Tavella

(57) ABSTRACT

A method of building ice structures using guidelines attached to posts to form a framework. Water is sprayed on the frame from sprinklers. Ice forms on the guidelines and grows until the ice supports itself. The structures are built higher as guidelines are added above each previous row of ice. As the ice continues to build up over time, the structures grow in height and thickness to be strong, freestanding structures. The method for creating ice pillars involves the following: Installing vertical posts, positioned around a sprinkler; attach guidelines from post to posts, creating a framework; and spraying water at low temperatures causing ice to form on framework. If desired height of pillar has not been reached, raise sprinkler and attach new guidelines above previous guidelines to existing posts. If desired height has been reached but desired thickness has not, continue spraying water at low temperatures.

19 Claims, 11 Drawing Sheets

ICE WALL SYSTEM AND METHOD OF CONSTRUCTION

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to ice wall construction and particularly to ice wall construction that utilizes a structure of guidelines between posts.

2. Description of the Prior Art

Ice walls and mazes can be created for amusement or entertainment as well as for practical reasons. Patents have been granted that describe different types of ice constructions. Spanish Patent ES 2,340,747 to Aparicio teaches a system of ice construction that uses a form or structure that is sprayed with water and possible additives. The structure can be positioned outdoors, if it is cold enough to form ice. It can also be placed in a refrigerated chamber where it is too warm to make ice naturally. This patent is focused primarily on ice sculptures or small-scale ice bodies because the invention uses a cooling chamber to make the ice when necessary.

U.S. patents include U.S. Pat. No. 8,511,042 to Christensen teaches a method for construction of ice structures that uses a frame similar to a sawhorse to hold and form icicles. Once the icicles are sufficiently formed, they are removed from the frame. These icicles are then used to form a framework, such as a wall portion. Water is then sprayed on to this framework to grow additional ice. Once sufficient ice has been formed, the wall is complete. U.S. Pat. No. 10,422,564 to Christensen et al. teaches and apparatus and method for constructing ice structures. This patent uses, in one embodiment, a box containing a number of tubes that are filled with water. Once filled, the tubes are frozen. The ice is removed from the tubes and is then used to form ice structures. In another embodiment, a table having a wire grid formed on it is used to grow icicles that are then used to form ice structures. U.S. Pat. No. 10,664,204 to Youngstrom teaches a method if creating ice structures that uses balloons that are filled with water and frozen to make ice logs. The balloons can be shaped before freezing. Once frozen, the logs can be used as is or cut to any desired length and the balloons can be removed as well. The logs can then be stacked or formed into a desired shape and, provided it is below freezing, covered with snow and more ice to form a complete structure.

All of these methods and devices will work to make an ice form as desired. However, none of them is practical for forming complex walls of ice for an ice maze for example. The others are very labor intensive comparatively. The use of icicles to form a structure does work, but it requires a lot of labor and ice to be formed just to make a form to support ice to make a wall.

BRIEF DESCRIPTION OF THE INVENTION

The instant invention overcomes the difficulties described above. It is a method of building ice structures using guidelines attached to posts to form a framework. Water is sprayed on the frame from sprinklers. Ice forms on the guidelines and grows until the ice supports itself. The structures are built higher as guidelines are added above each previous row of ice and repeated as the structure is built to completion. As the ice continues to build up over time, the structures grow in height and thickness to be strong, free-standing structures.

The method for creating ice pillars involves the following steps. First, install vertical posts, positioned around a sprinkler. Second, attach guidelines from post to post, connecting posts, and creating a framework. Next, spray water at low temperatures causing ice to form on framework. If the desired height of the pillar has not been reached, raise the sprinkler and attach new guidelines above previous guidelines to existing posts. If the desired height has been reached but the desired thickness has not, continue spraying water at low temperatures until the desired thickness has been reached.

To create ice walls, the procedure is as follows: First, install vertical posts around two sprinklers, positioned apart from each other, but close enough for their sprays to overlap. Next, attach guidelines to the posts, connecting the posts where walls are desired. Next, spray water at marginal temperatures causing ice to form on the posts and the guidelines. Next, raise the sprinklers and attach new guidelines higher and repeat the process. If desired height has been reached but desired thickness has not, continue spraying water at a low temperature.

To create an ice maze, install sprinklers in a grid layout, close enough for the spray to overlap. Next, install posts around sprinklers and attach guidelines to the posts to connect the posts where walls are desired. Next, spray water at marginal temperatures, causing ice to form on the posts and guidelines. Next, raise sprinklers and attach new guidelines higher and repeat the process. If the desired height has been reached but the desired thickness has not, continue spraying water at low temperatures.

To build ice floors in pillars, walls and mazes: (used for access to top and inside of structures, as well as reinforcing the ice structures), attach guidelines crossing inside walls, connecting the posts used to build existing structures.

The phrase "low temperature" means herein, a temperature at which liquid water is converted to solid ice by freezing.

DETAILED DESCRIPTION OF THE INVENTION

Referring now to the figures and particularly to FIGS. 1-4, FIG. 1 is a top view of poles and sprinklers showing the ice patterns that build up on poles.

Figure 1:
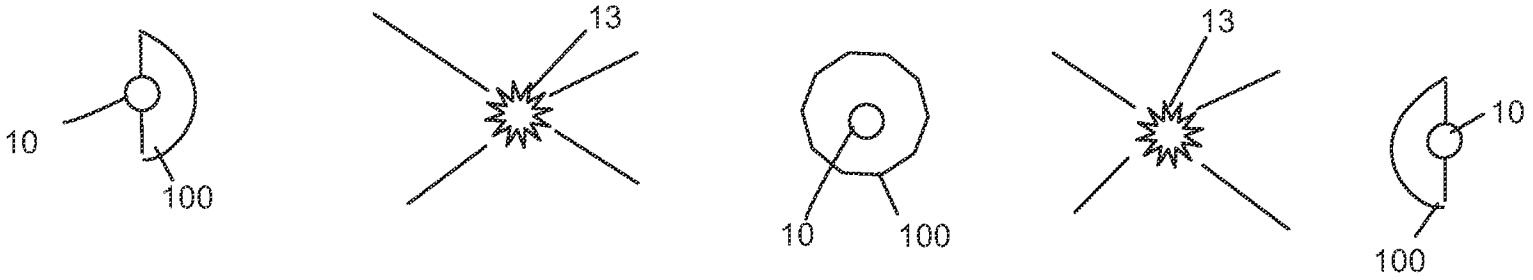
FIG. 1 is a top view of poles and sprinklers showing the ice patterns that build up on poles.
Figure 2:
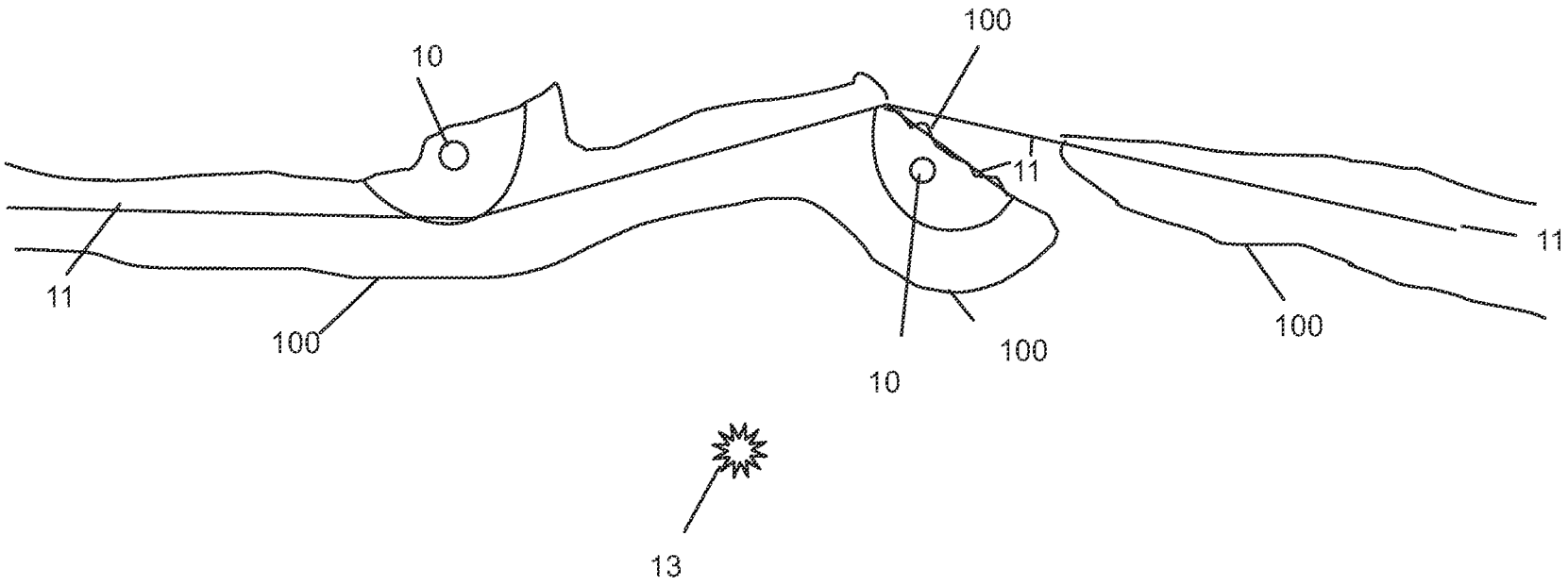
FIG. 2 is a top view of a sprinkler, poles and guidelines showing the ice buildup on the poles and guidelines.

FIG. 2 is a top view of a sprinkler, poles and guidelines showing the ice buildup on the poles and guidelines.

Figure 3A:
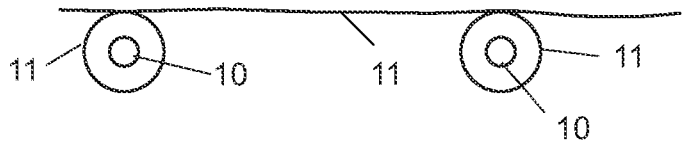
FIG. 3*a* is a top view of a straight across pattern for ice wall construction.
Figure 3B:
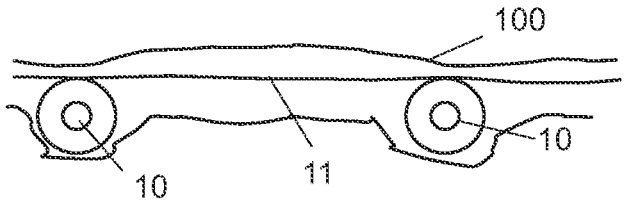
FIG. 3*b* is a top view of an ice wall being formed using a straight across pattern.
Figure 3C:
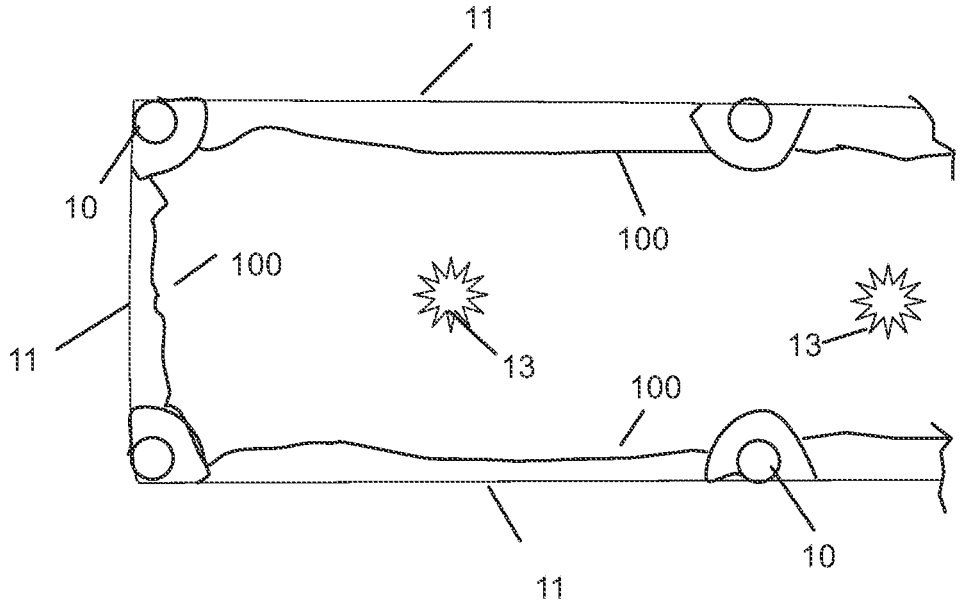
FIG. 3*c* is a top view of an ice wall under construction using the straight across pattern.

FIGS. 3*a*-3*c*, provide details of the construction of an ice wall using a straight across pattern are shown. These views are top detail views of how the ice builds around the posts and guidelines. Note that in all cases, it is important for the ice walls to be solid all the way through for structural purposes. Growing the outer guidelines until they grow together is preferred, as it will be the strongest and longest lasting. If the ice from the walls is not growing thick enough to fill in the wall, a floor may be built inside of the wall, as discussed below. FIG. 3*a* is a top view of a straight across pattern for ice wall construction. Typically, walls will be built to be straight, or in a grid pattern. Straight walls can have various uses, such as in mazes, courtyards, castle/palaces, or other designs. In this type of construction, posts 10 are set as shown. Guidelines 11 are then wrapped around the posts as shown in FIG. 3*a*. Wrapping guidelines 11 in the same direction twice in a row creates a section of wall where icicles formed on the guidelines create a hanging sheet of icicles, unsupported until longer growth is achieved, which allows icicles to connect to previously grown ice layers. While this can create desired aesthetics, it may cause the guidelines to sag in the center of the guideline until the icicles attach to the previous layer.

FIG. 3*b* is a top view of an ice wall being formed using a straight across pattern. Here, ice has formed around the posts and guidelines. As water is applied to the posts and guidelines, icicles form. These views are top detail views of how the ice builds around the posts and guidelines. As shown, the ice 100 builds on the side of the posts 10 that are being hit by water from the sprinklers. Thus, to make the ice concentric around the post, two sprinklers are needed on either side, hitting the posts from opposite directions.

FIG. 3*c* is a top view of an ice wall under construction using the straight across pattern. Here, the guideline 11 can be placed inside, outside, or diagonally in relation to the poles. The figures below show some of the possible patterns of guidelines. Ice 100 then forms around the posts and guidelines as shown.

As guidelines are added to increase the height of the walls, alternating the direction of the wrap around the post creates a crisscross pattern when viewed from above. This also makes the walls stronger due to the ice connecting to subsequent layers in the center where the lines cross. The first guideline is wrapped directly around the post, while subsequent layers will be around the ice that has formed on the posts. This process can be repeated until desired height is achieved. Variations of direction can be done to create different aesthetics.

Figure 4A:
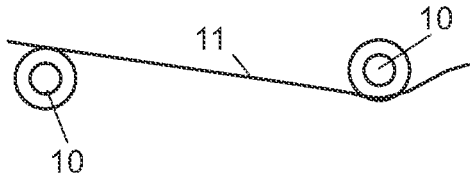
FIG. 4*a* is a top view of a structure for an ice wall construction using alternating guidelines, showing the placement of the first guideline.

FIG. 4*a* is a top view of a structure for an ice wall construction using alternating guidelines, showing the placement of the first guideline 11 attached to the posts 10.

Figure 4B:
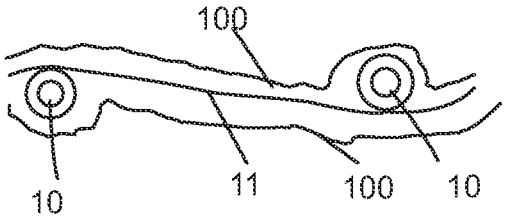
FIG. 4*b* is a top view of a structure for an ice wall construction using alternating guidelines, showing the growth of ice on the first guideline.

FIG. 4*b* is a top view of a structure for an ice wall construction using alternating guidelines, showing the growth of ice 100 around the posts 10 on the first guideline 11.

Figure 4C:
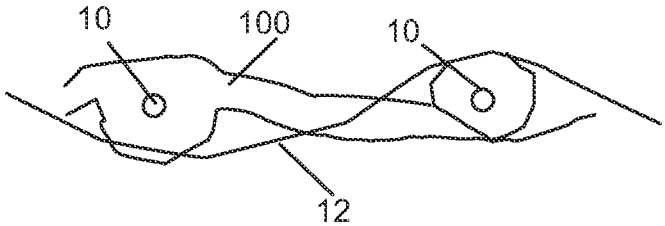
FIG. 4*c* is a is a top view of a structure for an ice wall construction using alternating guidelines, showing the placement of the first guideline and a second guideline.

FIG. 4*c* is a is a top view of a structure for an ice wall construction using alternating guidelines, showing the placement of the first and a second guidelines. In this structure, the structure of FIG. 4*b* has a second guideline 12 added as shown. Note that this second guideline 12 is positioned on the opposite side of the poles 10 than the first guideline and elevated above ice formed in FIG. 4*b* allowing for new ice growth to make the wall higher.

Figure 4D:
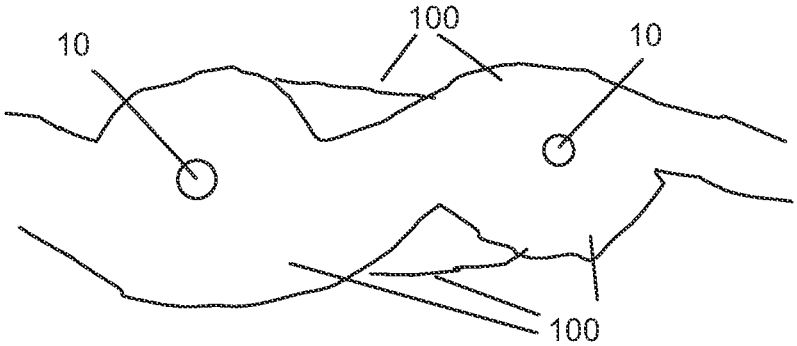
FIG. 4*d* is a top view of ice growth for an ice wall construction using alternating guidelines, showing growth based on two guidelines.

FIG. 4*d* is a top view of ice growth for an ice wall construction using alternating guidelines, showing growth based on two guidelines. Here, the ice 100 completely covers the posts 10 and both guidelines, 11 and 12.

Straight Walls

Typically, walls are built in straight, or in a grid pattern. This is the method that has been described thus far. Straight walls can have various uses, such as in mazes, courtyards, castle/palaces, or other designs. However, this method of building can be used to create different types of walls or structures. A combination of structures can be combined to create the desired plan design.

Figure 5:
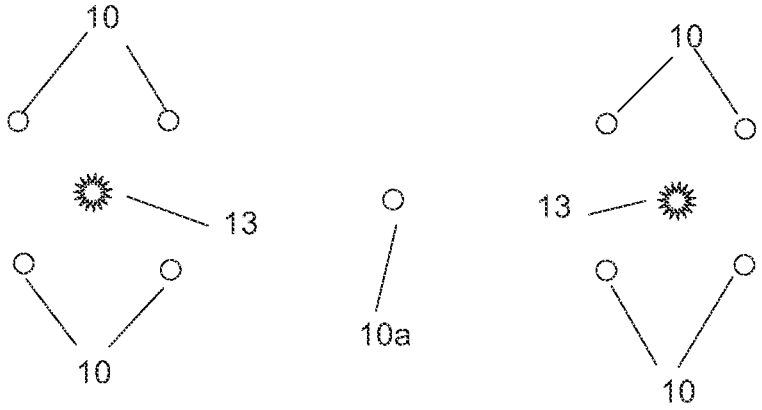
FIG. 5 is a top view of the basic layout of poles and sprinklers for an ice wall using the invention.

FIG. 5 is a top view of the basic layout of poles 10 and sprinklers 13 for an ice wall using the invention. In this configuration two square structures of four poles 10 positioned around a sprinkler 13 are formed (note that the number of poles may vary). A central pole 10*a* is placed between the two squares as shown.

Figure 6:
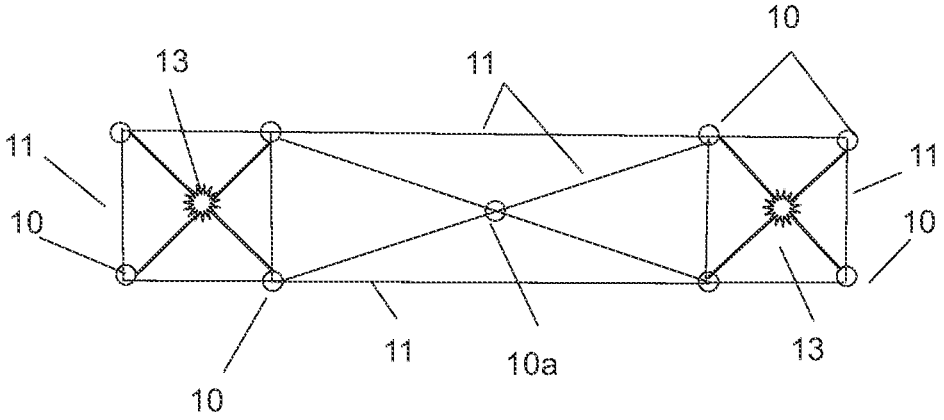
FIG. 6 is a top view of the basic layout of poles and sprinklers and guidelines for a floor assembly for an ice wall using the invention.
Figure 14:
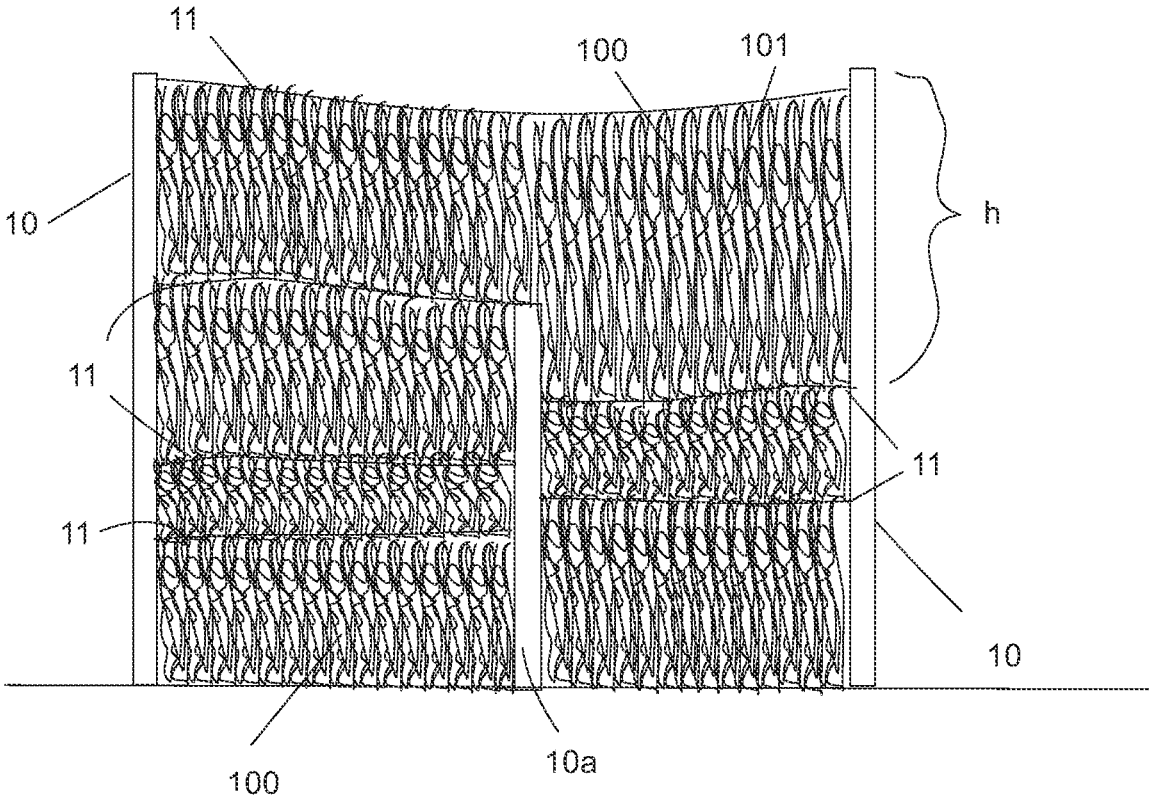
FIG. 14 is a side view of an ice wall built using the instant invention.

FIG. 6 is a top view of the basic layout of poles and sprinklers and guidelines for a floor assembly for an ice wall using the invention. In this figure, the poles 10 and sprinkler 13 arrangement of FIG. 5 is shown with added guidelines 11. Note that the added guidelines between the poles 10 and the sprinklers 13 are also used to help support the sprinklers 13. In this structure a floor or can be formed, using the guidelines between the poles and the sprinklers and the support poles 10*a*. As shown in FIG. 14, the center pole 10*a* is shorter than the outer poles.

To build ice floors in walls or pillars: (used for access to top and inside of structures, as well as reinforcing the ice structures), attach guidelines 11 crossing inside walls, connecting posts used to build existing structures. A shorter post 10*a* can be placed in the center of a wall section to act as support for guidelines 11. These shorter posts 10*a*, can be installed at any time as needed. This short post 10*a* supports these guidelines and causes them to droop less. Multiple layers of outer guidelines 11 are installed and will have had ice growth on them before the floor guidelines are installed. The floor guidelines are installed about halfway up the height of the tall posts, or the total height of the expected wall. Once the walls are done, the floor guidelines fill in the center of the wall making the walls fairly solid from one side to the other. They add fortification to the wall. Moreover, the space above the shorter pole is an open space that can be accessed. The floor guidelines form a solid base that can be used to move within the space. Multiple layers of floor can be added for taller walls. Floors can be placed as high as top guidelines to make solid structures with no access.

Figure 7:
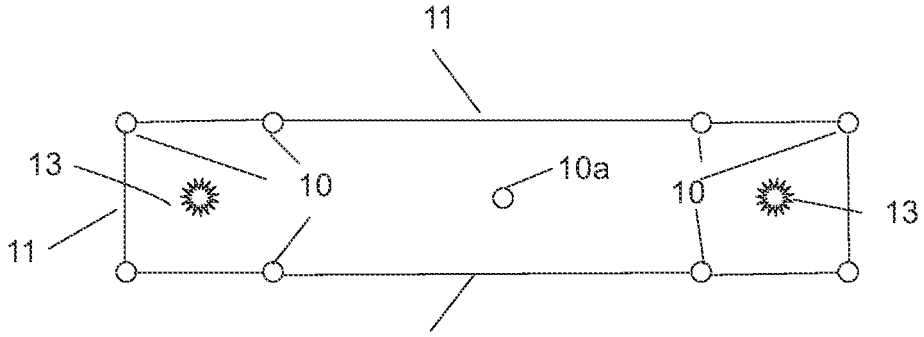
FIG. 7 is a basic plan of a straight wall section of structure for a straight ice wall.

FIG. 7 is a basic plan of a straight wall section of structure for a straight ice wall. Again, in this wall section, the figure shows poles 10, guidelines 11 and sprinklers 13. The guidelines are formed around the poles and on the sides of the walls.

Figure 8:
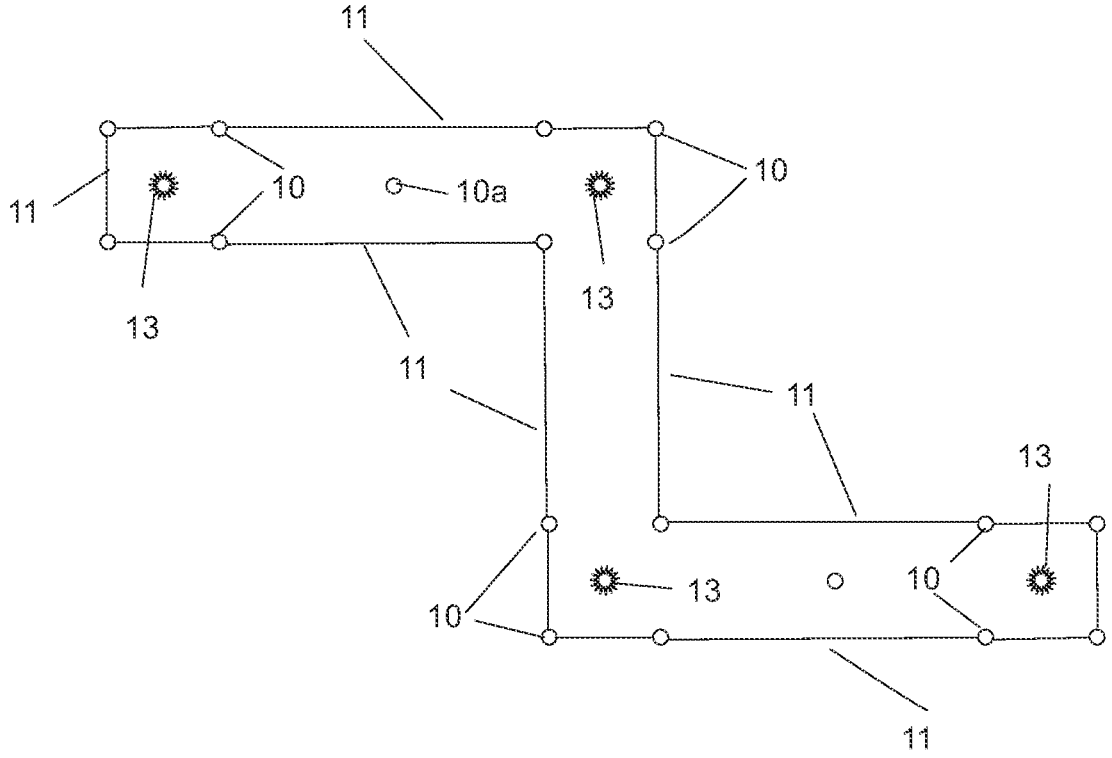
FIG. 8 is a detail view of the layout for a length of straight walls for an ice wall.

FIG. 8 is a detail view of the layout for a length of straight walls with corners. Here, the walls form corners, as for a maze or other structure. Note how the guidelines 11 form the wall structure while the poles and sprinklers for two straight walls as shown in FIG. 5.

Figure 9:
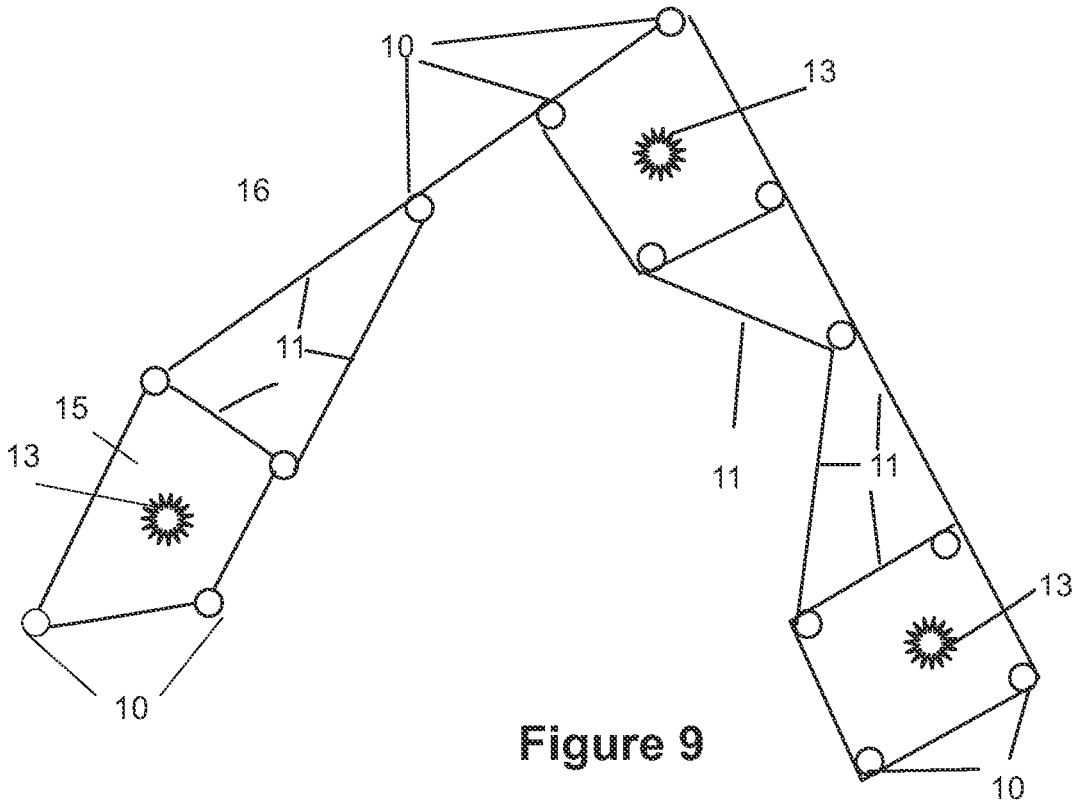
FIG. 9 is a detail view of the plan of an angled length of ice wall, showing the use of unusual shapes.

Curved and Specially Shaped Walls:

Walls do not need to be straight or square. The layout does not need to be a grid pattern. Posts can be trapezoidal in configuration to accomplish a circular or curved layout of walls. FIG. 9 is a detail view of the plan of a trapezoidal configuration length of ice wall. Note how the posts 10 are arranged in a trapezoidal pattern and spaced as needed to form the desired curve. Note that guidelines are not needed between all poles, as shown.

Figure 11:
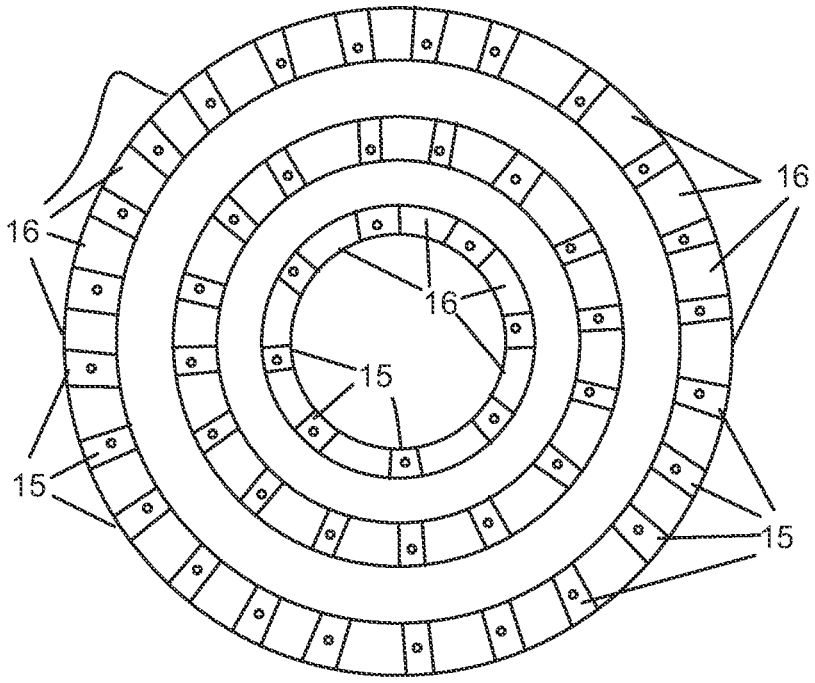
FIG. 11 is a detail view of the layout for multiple circular lengths of ice wall.

There are trapezoidal shapes with sprinklers 15 and without sprinklers 16, as shown. Note too that the guidelines 11 not only form the outer walls, but then enclose the spaces around the sprinklers 13 as well. FIG. 11 is a detail view of the layout for multiple circular lengths of ice wall. Note that each ring is made up of the trapezoidal shapes with sprinklers 15 and those without 16. Here, the technique described above, is used to form concentric circles. Such configurations can be opened at specific locations and the space between the circles can be blocked to form a circular maze.

Figure 10:
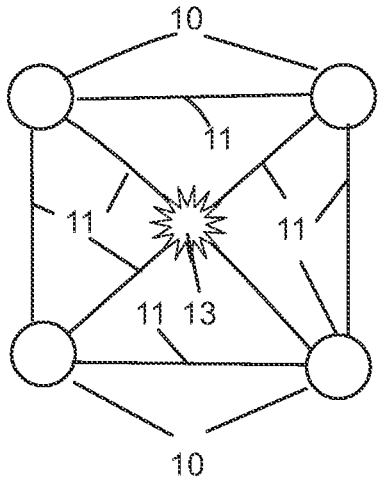
FIG. 10 is a detail of an ice pillar layout.

Pillar:

FIG. 10 is a detail of an ice pillar layout. To make a pillar, place multiple posts 10 radiated around a single sprinkler 13. Attach guidelines 11 to each post. Spray on to grow ice, and continue adding guidelines up the posts, increasing in height, until desired height is reached. In addition, guidelines 11 can be extended from the sprinkler 13 to each post 10. Ice growing on these center guidelines will build up a floor inside and strengthen the pillar and support the sprinkler.

Shapes:

FIG. 11 is a detail view of the structure to form a circular set of walls. Here, sets of units 15, similar to pillars of FIG. 10 are positioned as shown. Guideline sections 16 are then used to connect these units. Note that sprinklers are located only in the units designated as 15. In this way, a circle of any size can be formed by simply adding additional units. Note that as the circle gets larger, the lengths of the lines and pole positions will expand as shown.

Figure 12:
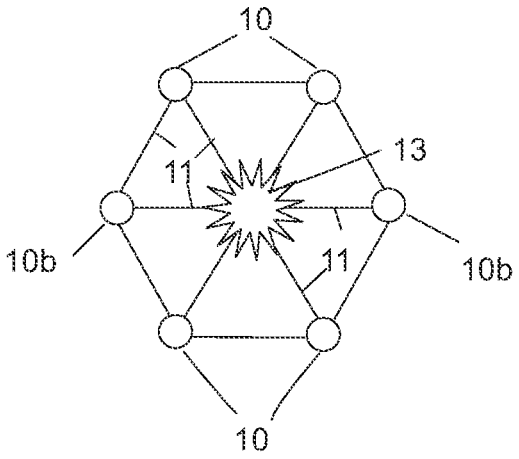
FIG. 12 is a detail view of the structure to form a shape.

FIG. 12 is a detail view of the structure to form a shape. As shown, poles 10 are connected by guidelines 11. A sprinkler 13 is positioned as shown. This unit can be used to form other shapes. To make a shape, additional posts 10*b* can be added to the wall anywhere along the wall to achieve different shapes. Walls that curve allow for more guidelines 11 to be run diagonally from sprinklers 13 or between posts.

Figure 13:
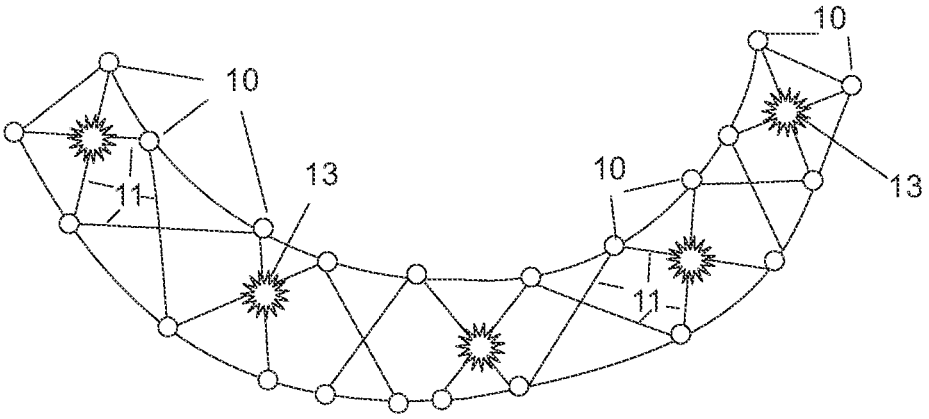
FIG. 13 is a detail view of the structure to form a larger shape.

FIG. 13 is a detail view of the structure to form a larger shape. Here, an arc or curved wall segment is shown. Again, by placing poles 10, guidelines 11 and sprinklers 13 in a desired formation, many shapes can easily be made.

It is important for the ice walls to be solid all the way through, for structural purposes. Growing the outer guidelines until they grow together is preferred, as it will be the strongest and longest lasting. If the ice from the walls is not growing thick enough to fill in the wall, a floor may be built inside of the wall. What I am referring to as a "floor" is essentially ice that is level within the wall that connects all sides of the interior of the wall. It serves several purposes, including structural support, a place for the lights and speakers, and as a way to access walls, lights, or areas from above.

FIG. 14 is a side view of an ice wall built using the instant invention. Here, the posts 10 and a shorter post 10*a* are shown. Guidelines 11 are shown between the posts at various heights. Icicles 100 are shown hanging from the guidelines 11. Note how the icicles descend from one guideline until they touch the top of the next lower guideline. As shown, the heights of the guidelines can vary. Note too, that in normal construction. Guidelines are added up the poles 10 as necessary to build the desired structure.

This figure also includes a floor area 101. Note the length of icicles 100 between the topmost guideline 11 and the guideline 11. This height h is a taller section with the lower guideline acting as a floor.

Heated lines 22 are used to allow for water runoff. The heated lines can be run down the walking paths, or run perpendicularly under the walls, typically running in relation to the topography. Without the heated lines, ice forms solid between the walls as water from the sprayers builds up. The heated lines keep a clear path for the excess water to run off.

One single heated line can be used to keep ice from building up so much and to allow water to run off and not pool up in the walkways. Multiple heated lines can be used to keep ice from building up as much or at all. If the walking paths are on the existing ground, or an aggregate or other surface will be added in lieu of ice pathways, the multiple heated lines are the best option.

Figure 15:
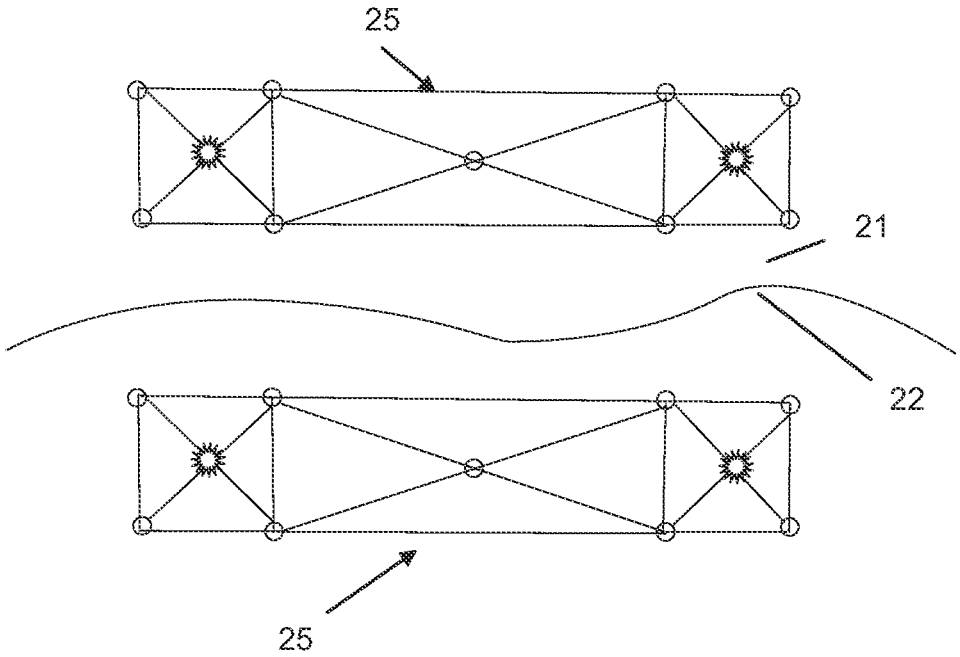
FIG. 15 is another top detail view of a pair of walls with a walkway in between that is maintained by a heated walkway.

Heated lines 22 are shown in FIG. 15. This is a top detail view of a post 10 and guideline 11 set up for a pair of walls 25 with a walkway in between that is maintained by a heated walkway 21.

Figure 16:
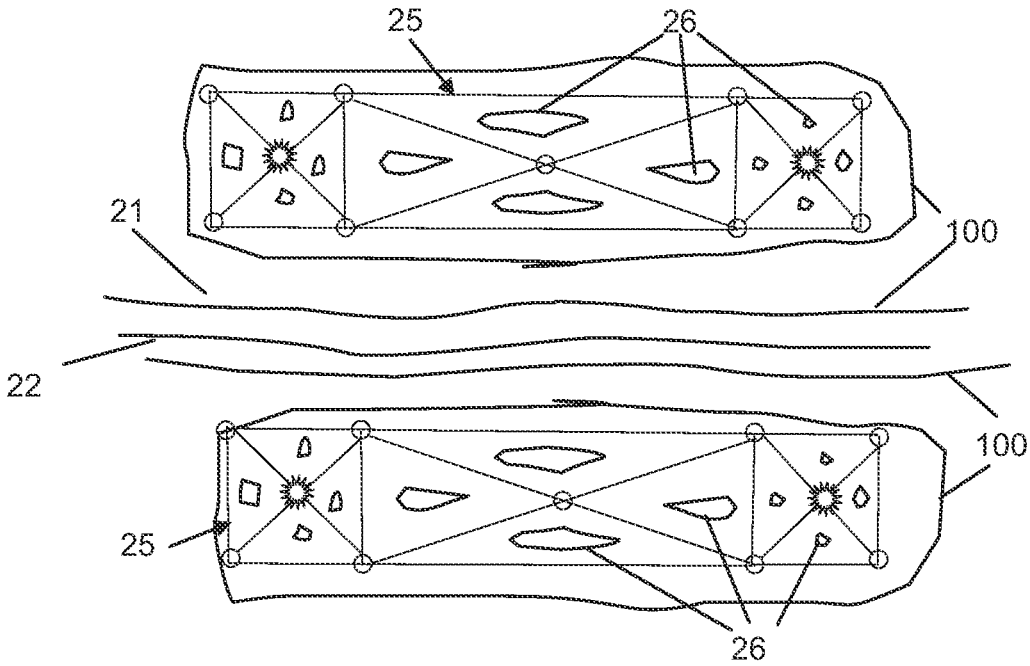
FIG. 16 is a top detail view of a pair of walls, with iced formed on them, with a walkway in between that is maintained by a heated walkway showing gaps that can form in the ice floors of walls.

In FIG. 16, the walls 25 are shown with a walkway 21 between them, Note the sprinklers 13 positioned between the walls 25. As the walls are being built, the heated line is charged (either electrically or by heated fluid). As ice is formed on the walls 25, with a walkway in between that is maintained by heated lines 22. The figure shows gaps 26 that can form in the ice floors within the walls 25. These gaps will disappear as the ice grows and fills them in.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. An ice wall system comprising:

a) at least two posts having an outside surface, positioned apart, each post having a height;

b) at least one guideline, attached to each of said at least two posts and being suspended at a height above a ground surface and positioned diagonally in relation to said at least two posts; and c) at least one sprinkler, positioned between said at least two posts to apply water on said at least two posts and said at least one guideline.

2. The ice wall system of claim 1 wherein the at least one guideline is positioned on the outside of said at least two posts.

3. The ice wall system of claim 1 further comprising a second guideline attached to each of said at least two posts and being suspended above said the at least one guideline.

4. The ice wall system of claim 2 further comprising a second guideline attached to each of said at least two posts and being suspended above said the at least one guideline.

5. The ice wall system of claim 3 wherein said second guideline is positioned in an alternating direction of said at least one guideline, thereby creating a crisscross pattern when viewed from above.

6. The ice wall system of claim 1 further comprising an ice floor formed in said ice wall system.

7. The ice wall system of claim 3 further comprising an ice floor formed on said at least one guideline and said second guideline.

8. The ice wall system of claim 1 further comprising a heated line positioned adjacent to and parallel to said ice wall system.

9. The ice wall system of claim 8 further comprising a second ice wall system positioned adjacent to and running parallel to, but spaced apart from the ice wall system, and further wherein said heated line is positioned between said ice wall system and said second ice wall system.

10. A method of building an ice wall system comprising the steps of:

a) installing at least two posts having an outside surface, into a ground surface, positioned apart, each post having a height;

b) installing at least one guideline, attached to each of said at least two posts and being suspended at a height above said ground surface;

c) positioning at least one sprinkler between said at least two posts to apply water on said at least two posts and said at least one guideline; and d) running said at least one sprinkler until a plurality of icicles form on said at least one guideline and extend downward to said ground surface.

11. The method of claim 10 wherein the at least one guideline is positioned on the outside of said at least two posts.

12. The method of claim 10 wherein the at least one guideline is positioned diagonally in relation to said at least two posts.

13. The method of claim 10 further comprising the step of: attaching a second guideline to each of said at least two posts and being suspended above said the at least one guideline.

14. The method of claim 12 further comprising the step of attaching a second guideline to each of said at least two posts and being suspended above said the at least one guideline.

15. The method of claim 14 wherein said second guideline is positioned in an alternating direction of said at least one guideline, thereby creating a crisscross pattern when viewed from above.

16. A method of making an ice wall system comprising the steps of:

a) installing a plurality of posts, having an outside surface, into a ground surface, said plurality of posts being spaced apart and in a linear alignment;

b) installing a second plurality of posts into a ground surface, said plurality of posts being spaced apart and in a linear alignment and also being installed parallel to said first plurality of posts;

c) installing a guideline on the outside surface of said first plurality of posts;

d) installing a second guideline on the outside surface of said second plurality of posts;

e) installing a third guideline diagonally between said first plurality and said second plurality of posts;

f) installing a fourth guideline diagonally, in an opposite direction from said third plurality of posts, between said first plurality and said second plurality of posts, to form a crisscross pattern;

g) installing a plurality of sprinklers between said first and second plurality of posts; and h) running said plurality of sprinklers until a plurality of icicles form on said first and second guidelines and extend downward to said ground, thereby forming an ice wall.

17. The method of claim 16 further comprising the step of running said plurality of sprinklers until a layer of ice forms on said third and fourth guidelines, forming a floor between said first and second plurality of posts.

18. The method of claim 16 further comprising the step of placing a heated line adjacent to and parallel to said ice wall.

19. The method of claim 17 further comprising the steps of:

a) forming a second ice wall, positioned adjacent to and running parallel to, but spaced apart from said ice wall, and further wherein a heated line is positioned between said ice wall and said second ice wall.

* * * * *